United States Patent [19]

Blume, Sr.

[11] 4,392,653

[45] Jul. 12, 1983

[54] GAME APPARATUS

[76] Inventor: James W. Blume, Sr., 1851 Glatt, Arnold, Mo. 63010

[21] Appl. No.: 316,752

[22] Filed: Oct. 30, 1981

[51] Int. Cl.[3] ..... A63B 63/04; A63B 63/08

[52] U.S. Cl. ..... 273/400

[58] Field of Search ..... 273/398–402, 273/336–339

[56] References Cited

U.S. PATENT DOCUMENTS

| | | | |
|---|---|---|---|
| 324,189 | 8/1885 | Thomas | 273/400 |
| 3,653,662 | 4/1972 | Welbourn | 273/400 |
| 3,823,942 | 7/1974 | Duncan | 273/338 X |
| 3,892,407 | 7/1975 | Higgins | 273/336 |
| 4,045,028 | 8/1977 | Dyess | 273/338 |
| 4,180,266 | 12/1979 | Morin et al. | 273/338 |

*Primary Examiner*—Paul E. Shapiro

*Attorney, Agent, or Firm*—Haverstock, Garrett & Roberts

[57] ABSTRACT

A game apparatus for playing a toss type skill game wherein the apparatus forms a target area for the game and has an open topped container defined by a bottom wall and a peripheral wall extending upwardly from around the bottom wall, a hole through the bottom wall at a location spaced from the peripheral wall, and a tubular member positioned extending upwardly from the bottom wall through the hole, the tubular member having an open upper side forming a target for receiving objects thrown at the apparatus. A second embodiment of the game apparatus is provided wherein the height of the tubular member may be varied for varying the difficulty of the game.

13 Claims, 5 Drawing Figures

GAME APPARATUS

This invention relates to a game apparatus intended for use by players of all ages and designed primarily to be played competitively requiring that the players use their skills and abilities to toss playing pieces a predetermined distance into or near the immediate vicinity of a receiving member somewhat similar to the game of horseshoes. The subject game is readily transportable for convenience of storage and for play at any location and it has no members that must be driven into the ground. It is anticipated that the height of the receiving member or target may be varied, thereby changing the relative difficulty of the game and the skill required.

Prior art devices that have been considered and are of some general interest to show the state of the art are disclosed in U.S. Pat. Nos. 1,098,872; 1,230,503; 2,204,078; 2,265,571; 1,541,897; 3,119,619; 3,892,407 and 4,203,592.

It is therefore a principal object of the present invention to teach the construction of an improved game apparatus for use by players of all ages and having means which may be varied thereby changing the relative difficulty of the game and the skill required.

Another object is to teach the construction of an improved game apparatus that is readily transportable.

Another object is to teach the construction of an improved game apparatus that may be conveniently stored.

Another object is to teach the construction of an improved game apparatus for play at any location.

Another object is to provide a toss type game which has no parts that need to be driven into the ground or attached to a floor.

Another object is to teach the construction of a toss type game that can be played indoors and outdoors.

Another object is to teach the construction of an improved game apparatus which is inexpensive and simple to construct.

These and other objects and advantages of the present device will become apparent after considering the following detailed specifications in conjunction with the accompanying drawings wherein.

Figure 1:
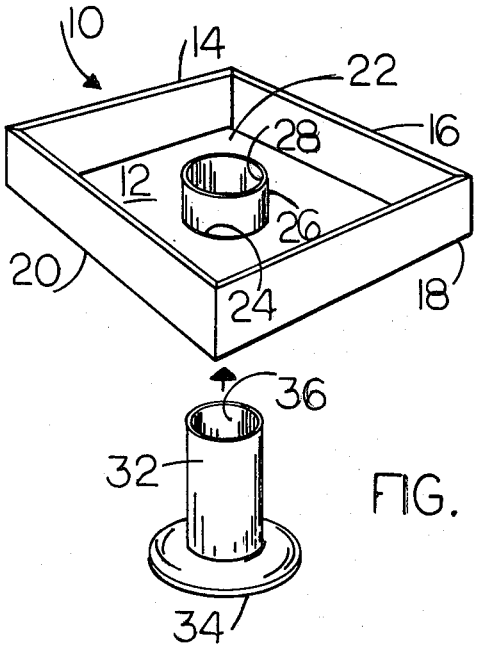
FIG. 1 is an exploded perspective view of one of the playing piece receiving assemblies of a game apparatus constructed according to one embodiment of the present invention.

Referring to the drawing more particularly by reference of numbers, number 10 in FIG. 1 identifies one of a pair of similar substantially square shaped box assemblies each of which includes a bottom wall portion 12 and side wall portions 14, 16, 18 and 20 extending upwardly therefrom enclosing a space 22 therebetween adaptable to receive and hold playing pieces when tossed therein. The bottom wall portion 12 of each of the box assemblies 10 includes an opening 24 preferably but not necessarily centrally located therein, and having a tubular portion 26 extending upwardly therefrom a distance approximately equal to the height of the side wall portions 14–20. The tubular portion 26 defines a target member having a chamber 28 therein for receiving and holding playing pieces when tossed therein. Although it is recognized that various materials of construction are available, it is preferred that the box assemblies be constructed of a lightweight, durable material such as certain plastics or wood materials which are readily available and inexpensive. In addition, each of the box assemblies 10 could be easily fabricated and assembled from component parts which could be injected molded and snapped into place prior to use. It is also anticipated that the entire box assemblies 10 could be molded as unitary structures. Furthermore, each side wall portion 14–20 of the box assemblies 10 may be sloped or tapered such as shown at 30 in FIG. 2 to enhance the possibility of retaining playing pieces tossed therein.

An insertable tubular receiving member 32, usually though not necessarily taller than the side walls 14–20, having a flange portion 34 located on one end thereof is slidably positioned into telescopic engagement with the tubular target member 26 incorporated within the box assembly 10 so as to increase the overall height of the target. The insertable receiving member 32 also includes a chamber 36 therein for receiving and holding playing pieces when tossed therein and the overall height of the receiving member 32 determines the relative difficulty of the game. The taller the receiving member, the greater the skill level required to toss a playing piece into it from the top. The use of a number of insertable receiving members of various heights enables players to vary the relative difficulty of the game. Children may elect not to use the insertable receiving member 32 and simply attempt to toss the playing pieces into the tubular portion 26 incorporated as part of the box assembly 10, whereas older players may elect to use the insertable receiving member 32 thereby increasing the degree of difficulty of the game. It is also anticipated that a plurality of insertable receiving members, each having a different height, be provided with the subject game.

Figure 4:
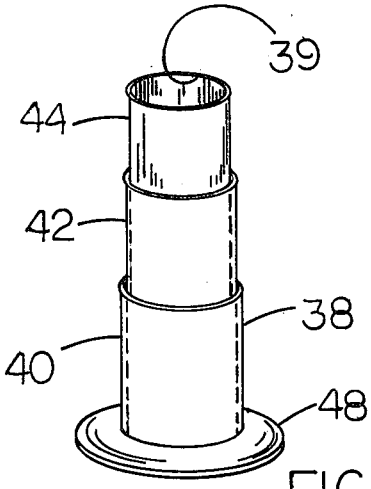
FIG. 4 is a side elevational view of another embodiment of an insertable central member for receiving playing pieces usable with the device of FIG. 1; and, FIG. 5 is a diagrammatic representation of the subject game apparatus in use by a player.

FIG. 4 shows another embodiment of an insertable receiving member 38 having a central chamber 39 therein for receiving and holding playing pieces when tossed therein and whose height may be adjusted for use instead of providing a plurality of different size and length receiving members 32. The receiving member 38 includes a number of concentric tubular members as illustrated by members 40, 42 and 44 which are slidably nested one within the other in frictional engagement with one another to form a telescopically adjustable member whose height may be adjusted as desired to any position from a minimum height when the tubes 40–44 are completely collapsed, to a maximum when all of the tubes 40–44 are pulled upwardly to a fully extended condition. The height of the receiving member 38 is maintained after it has been adjusted by the friction between the members 40–44. The adjustable receiving member 38 includes an annular flange portion 48 at one end.

Figure 2:
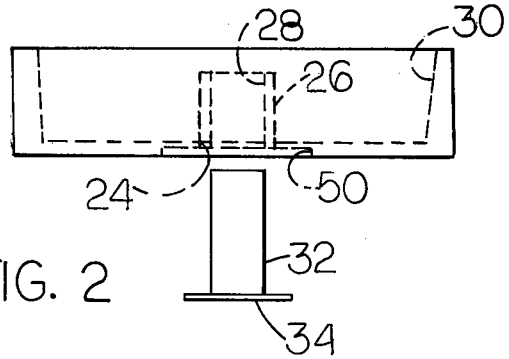
FIG. 2 is a side elevation view of the playing piece receiving assembly of FIG. 1.
Figure 3:
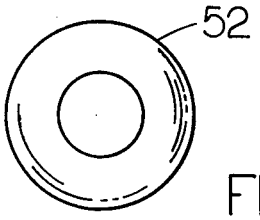
FIG. 3 is a top plan view of one embodiment of a playing piece for use with the device of FIG. 1.

As shown in FIG. 2, the bottom wall portion 12 includes an annular cavity or counterbore 50 located extending around the tubular target member 26 for receiving the flange portion 34 of the receiving member 32 or the flange portion 48 of the receiving member 38 such that the box assembly 10 will have a flat lower surface for resting on the floor or other playing surface when the game apparatus is used.

The playing pieces 52 used in the playing of the subject game are usually round, flat, and generally washer-like in shape and sized to fit into the central chambers 36 or 39 of the receiving members 32 or 38 respectively. Each playing piece may be made of, or coated with, a rubberized material or any other protective covering as desired. It is also anticipated that many different geometric shapes can be used for the playing pieces 52, and additional pieces may be added to accommodate any desired number of players or teams of players. Playing pieces of a different geometric shape and colors can also be provided to identify the various players.

Figure 5:
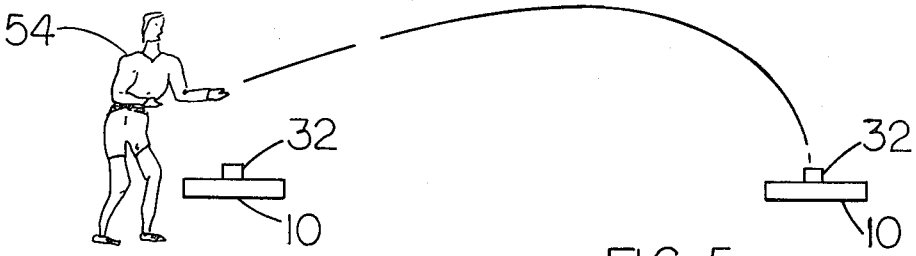

The object of the subject game is to toss the playing pieces 52 a predetermined distance either into or near the immediate vicinity of the centrally located target 26 and/or receiving member 32 or 38 if located therein, with each player accumulating a predetermined number of points based upon the position of his playing pieces relative to the target and central receiving member, the player accumulating the most points or reaching a predetermined number of points first being the winner. Play is started by positioning the pair of box assemblies 10 a predetermined distance apart from each other as shown in FIG. 5. This distance can be varied from just a few feet for children to distances as great as 20 to 35 ft. for adult play. Each player 54 in turn stands adjacent to or in the near vicinity of one of the box assemblies 10 and tosses a preselected number of playing pieces 52, generally two, toward the opposite box assembly 10 in an effort to toss them into the chamber 36 or 39 within the receiving member 32 or 38 respectively located therein. The players will take their turns in order until the game is completed. One possible scoring system for awarding points is to award five points for each playing piece tossed within the chamber 36 or 39 of the centrally located receiving member 32 or 38 respectively; two points for each playing piece coming to rest within the enclosed space 22 of the box assembly 10 adjacent to and surrounding the receiving member; and one point for the closest playing piece within a predetermined distance from the perimeter of the box assembly 10.

Different point values can be assigned to each of the various insertable receiving members 32 or the height of the adjustable receiving member 38, if it is used. Also, a handicap system can be established wherein various heights of the receiving member could be used by individual players or teams of players depending upon their skill or age.

Thus there has been shown and described several embodiments of game apparatus which fulfill all of the objects and advantages sought therefor. It will be apparent to those skilled in the art, however, that many changes, modifications, variations, and other uses and applications for the subject device are possible. All such changes, modifications, variations and other uses and applications which do not depart from the spirit and scope of the invention are deemed to be covered by the invention which is limited only by the claims which follow.

What is claimed is:

1. A game apparatus comprising a base member having side walls extending upwardly therefrom around the perimeter thereof and a hole near the center thereof spaced from the side walls, a tubular member extending upwardly from the base and having a central cavity that registers with the hole forming a target, and a receiving member engageable with the tubular member for increasing the height of the target, said receiving member having a central cavity for receiving playing pieces tossed therein.

2. The game apparatus of claim 1 wherein the base member is generally square shaped.

3. The game apparatus of claim 1 wherein the side walls have opposed inner and outer surfaces, the inner surfaces facing the tubular member and being acutely angularly related relative to the normal to the base.

4. The game apparatus of claim 1 wherein the receiving member extends upwardly further than the side walls when engaged with said tubular member.

5. The game apparatus of claim 1 including a plurality of receiving members, each having a different length.

6. The game apparatus of claim 1 wherein the receiving member includes means adjustable to vary the height thereof.

7. The game apparatus of claim 6 wherein the means adjustable to vary the height includes a plurality of concentric tubular members nested one within the other.

8. The game apparatus of claim 1 wherein the receiving member is operable to be inserted into the tubular member and has an annular outwardly extending flange on one end for engagement with the base member when the receiving member is inserted into said tubular member.

9. The game apparatus of claim 8 wherein the base member has an annular cavity formed therein around the central hole for receiving the annular flange on the insertable receiving member.

10. A method of playing a game comprising providing a base member having side walls extending upwardly therefrom around the perimeter thereof, an opening positioned near the center of said base member spaced from said side walls, providing a tubular member extending upwardly from said base member and having a central cavity that registers with said opening forming a target, providing a receiving member insertable through said tubular member for increasing the height of the target, said receiving member having a central cavity for receiving playing pieces tossed therein, providing a plurality of playing pieces of a size to be thrown into the central cavity of said receiving member, tossing a predetermined number of said playing pieces from a predetermined distance from the base member toward the target with the intention of having them enter the center cavity of said receiving member, and scoring the value of selected ones of playing pieces tossed based upon the position of said playing pieces when they come to rest relative to said target.

11. The method of claim 10 further comprising varying the height of said receiving member for varying the difficulty of the game.

12. A game apparatus for playing a toss type skill game, said apparatus forming a target area for the game and comprising an open topped container defined by a bottom wall and a peripherial wall extending upwardly from around the bottom wall, a hole through the bottom wall at a location spaced from the peripherial wall, a first tubular member positioned extending upwardly from the bottom wall through said hole, said first tubular member having an open upper side forming a target for receiving objects thrown at the apparatus, said first tubular member having an outer cross sectional size and shape to match the shape of the hole through the bottom wall whereby said tubular member can be moved through the hole in the bottom wall of said container, means on said first tubular member adjacent one end thereof movable into engagement with the bottom wall of said container to limit movement thereof through said hole, and a second tubular member positioned for movement through said first tubular member and along the entire length thereof, the length of said second tubular member being greater than the length of said first tubular member.

13. The apparatus of claim 12 wherein said second tubular member includes a plurality of concentric tubular members slidably nested telescopically one within the other for varying the height thereof.

* * * * *